US009132304B1

(12) United States Patent
Griffin, Sr. et al.

(10) Patent No.: US 9,132,304 B1
(45) Date of Patent: Sep. 15, 2015

(54) SELF-CONTAINED FIRE-FIGHTING SYSTEM

(71) Applicants: Darwin Griffin, Sr., Helendale, CA (US); Catherine Hackney, Helendale, CA (US)

(72) Inventors: Darwin Griffin, Sr., Helendale, CA (US); Catherine Hackney, Helendale, CA (US)

( * ) Notice: Subject to any disclaimer, the term of this patent is extended or adjusted under 35 U.S.C. 154(b) by 126 days.

(21) Appl. No.: 13/861,358

(22) Filed: Apr. 11, 2013

Related U.S. Application Data

(60) Provisional application No. 61/625,546, filed on Apr. 17, 2012.

(51) Int. Cl.
*A62C 25/00* (2006.01)
*A62C 27/00* (2006.01)

(52) U.S. Cl.
CPC ..... *A62C 27/00* (2013.01); *A62C 25/00* (2013.01)

(58) Field of Classification Search
CPC ..... A62C 13/00; A62C 13/62; A62C 25/00; A62C 25/005; A62C 27/00
USPC ..... 169/13, 14, 18, 24, 52, 62; 239/172, 239/195, 197, 198, 289
See application file for complete search history.

(56) References Cited

U.S. PATENT DOCUMENTS

| | | | | | |
|---|---|---|---|---|---|
| 4,593,855 | A * | 6/1986 | Forsyth | 239/74 |
| 5,162,720 | A * | 11/1992 | Lambert | 320/104 |
| 5,303,866 | A * | 4/1994 | Hawks, Jr. | 239/142 |
| 5,409,067 | A | 4/1995 | Esposito | |
| 5,960,888 | A * | 10/1999 | Moore, Sr. | 169/62 |
| 6,079,135 | A * | 6/2000 | Ruiz | 40/316 |
| 2004/0055767 | A1 | 3/2004 | Hayes | |
| 2004/0226726 | A1 | 11/2004 | Holland | |
| 2006/0055378 | A1 * | 3/2006 | Bauerle et al. | 322/28 |
| 2008/0042822 | A1 * | 2/2008 | Wang | 340/472 |
| 2012/0024548 | A1 * | 2/2012 | Chang | 169/52 |
| 2012/0132445 | A1 * | 5/2012 | Mallon et al. | 169/24 |

* cited by examiner

*Primary Examiner* — Darren W Gorman
(74) *Attorney, Agent, or Firm* — RG Patent Consulting, LLC; Rachel Gilboy

(57) ABSTRACT

A self-contained firefighting system to be incorporated into the trunk of a motor vehicle to include a reel with 7 to 15 feet of easily deployable hose, a high-pressure pump, and a refillable reservoir for fire-extinguishing foam, intended for use in the vehicles of first responders such as police, highway patrol, and EMS units, as well as for use in private passenger vehicles.

13 Claims, 5 Drawing Sheets

SELF-CONTAINED FIRE-FIGHTING SYSTEM

CROSS-REFERENCE TO RELATED APPLICATION

The present application is related to and claims priority from prior provisional application Ser. No. 61/625,546, filed Apr. 17, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of fire-fighting systems and more specifically relates to self-contained firefighting system for use in a passenger vehicle(s).

2. Description of the Related Art

Many people use passenger vehicles to commute between locations. Few motorists carry a fire-extinguisher in their vehicle; and while public-safety personnel (police and highway troopers, firefighters and emergency medical service providers) may have firefighting capability, this capability may be limited and these personnel might or might not arrive at an accident scene in time. Fire trucks and other emergency vehicles respond to the vast majority of fires, but these vehicles may be occupied at other fires and are expensive and cumbersome to use. The best time to control and extinguish a fire is right when it first is ignited. First responders may be able to reach a fire quickly or be on the scene when one starts, but may not have an effective way to control or extinguish the fire. It would be desirable to have a handy on-board firefighting system designed for fast and effective emergency use, one that is able to effectively combat a small to medium size fire.

Various attempts have been made to solve the above-mentioned problems such as those found in U.S. Pub. No. 2004/0055767 to Hayes; U.S. Pat. No. 5,409,067 to Esposito; and U.S. Pub. No. 2004/0226726 to Holland. This art is representative of fire-fighting means. None of the above inventions and patents, taken either singly or in combination, is seen to describe the invention as claimed.

Ideally, a self-contained firefighting system for use in a passenger vehicle system should be user-friendly, safe to operate and, yet would operate reliably and be manufactured at a modest expense. Thus, a need exists for a reliable self-contained firefighting system for use in a passenger vehicle system to avoid the above-mentioned problems.

BRIEF SUMMARY OF THE INVENTION

In view of the foregoing disadvantages inherent in the known fire-fighting means art, the present invention provides a novel self-contained fire-fighting system. The general purpose of the present invention, which will be described subsequently in greater detail is to provide a portable suppression means for controlling fires.

A self-contained fire-fighting system for use in a passenger vehicle is disclosed herein, in a preferred embodiment, comprising a fire-fighting assembly including a reel, a deployable hose with a nozzle (the nozzle for controlling flow from the hose), a pump, a reservoir (tank), a high-pressure recharge fitting located on the reservoir, a pressure/refill indicator gauge, a powerer, an emergency indicator, and a GPS, wherein the fire-fighting assembly is self-contained for placement in the passenger vehicle. The fire-fighting assembly comprises in combination the reel, the at least one deployable hose, the pump, the reservoir, and the powerer (which may comprise a vehicle battery), the fire-fighting assembly being portable such that it can be loaded into and out of vehicles with relative ease.

The deployable hose is wrapped on the reel and is able to be wound onto and unwound from the reel as desired, wherein the reel is manually operated via a hand crank. Electric versions may be found in alternate embodiments. The deployable hose preferably comprises reflective strips as an indicator of where the deployable hose is located during lowlight conditions so as to prevent injury to onlookers (preventing a tripping hazard) and from damage to the deployable hose (caused by vehicles driving over the hose and the like).

The reservoir comprises an inner volume contained by an outer surface (shell of the tank) to hold at least one fire-fighting-liquid, the reservoir preferably having stabilizing arms such that movement within the vehicle is restricted. Gripping means on the bottom of the reservoir may also be used. The pump (preferably located in the reservoir tank) comprises a high-pressure-pump for discharging the (at least one) fire-fighting-liquid from the reservoir through the deployable hose when the pump is activated. The reservoir comprises a skid-frame, wherein the reservoir is also a pressurized container that is able to be recharged with the foam, for use. Fire-fighting-liquid may comprise foam (water or foam/water). Other fire-fighting liquids may be used. The pressurized container is able to maintain a constant pressure over an extended period (once charged—such that it is ready for use upon demand). The fire-fighting assembly is able to be removably installed in a trunk of the passenger vehicle; the passenger vehicle comprising a car, the skid-frame sitting stably on a floor of the trunk. Stability is enhanced by the stabilizing arms. Certain embodiments may comprise a 'sprinkler-style' hose that travels under the undercarriage of the vehicle to extinguish fires under the vehicle fed by the gas tank or other. Further, heat sensors may be used with the present invention such that the system is able to detect heat and for example start the pump running or the like.

The powerer is recharged via a battery or comprises the battery onboard the passenger vehicle in preferred embodiments and as such is in electrical communication with the battery. The powerer is able to be manipulated between an on-condition and an off-condition via a switch, wherein the powerer provides (or communicates) power to operate the pump when the switch is in the on-condition and no power is relayed during the off-condition. The pressure/refill indicator gauge is preferably located in a dash of the passenger vehicle, thus the driver (user) can keep an 'eye' on the state of charge on a regular basis with relative ease; other locations for placement are possible. The pressure/refill indicator gauge indicates a relative charge of the reservoir. When charge declines or after use the device is then recharged by appropriate means.

The emergency indicator indicates an in-use condition while operating the self-contained fire-fighting system; the emergency indicator providing a visual warning to on-coming motorists of an emergency situation, wherein the emergency indicator comprises a beacon with LED lights and is powered when the in-use condition exists. The emergency indicator is also operated by a switch (or may be operated directly via the on/off switch). In preferred embodiments the emergency indicator means further comprises an LED-light-bar located on an inside of a trunk-lid such that when the trunk is opened the oncoming traffic can see a warning, thus promoting safety for the operator. A GPS comprises a position tracker that is able to signal to at least one other responder a position-and-emergency-condition-present such that other responders can respond to help with the fire-fighting to extinguish the fire in a minimum amount of time. The fire-fighting assembly is self-contained for placement in passenger vehicle(s), and as such the fire-fighting assembly is useful for first response in fire-fighting situations.

A kit is also described herein including: the fire-fighting assembly, the emergency indicator(s), decals and a set of user instructions. Additional wiring may be included and pressure/refill indicator gauge(s) if mounting on dash of the vehicle.

A method of using a self-contained fire-fighting system for use in at least one a passenger vehicle is also disclosed herein comprising the steps of: opening a trunk lid (if in a car), starting an emergency indicator to provide a visual warning, deploying a deployable hose from a reel via a crank, activating a powerer via a switch to power a pump, evacuating foam (or other fluid) under pressure contained within a reservoir from the deployable hose using the pump spraying fire-fighting fluid onto a fire, controlling the fire until emergency personnel and equipment arrive, de-activating the powerer, rolling up the deployable hose onto the reel via the crank, closing the trunk lid (if in a car), and recharging the reservoir before a next usage. The system may be flushed out at necessary intervals.

The present invention holds significant improvements and serves as a self-contained fire-fighting system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, self-contained fire-fighting system for use in a passenger vehicle, constructed and operative according to the teachings of the present invention.

The various embodiments of the present invention will hereinafter be described in conjunction with the appended drawings, wherein like designations denote like elements.

DETAILED DESCRIPTION

Figure 1:
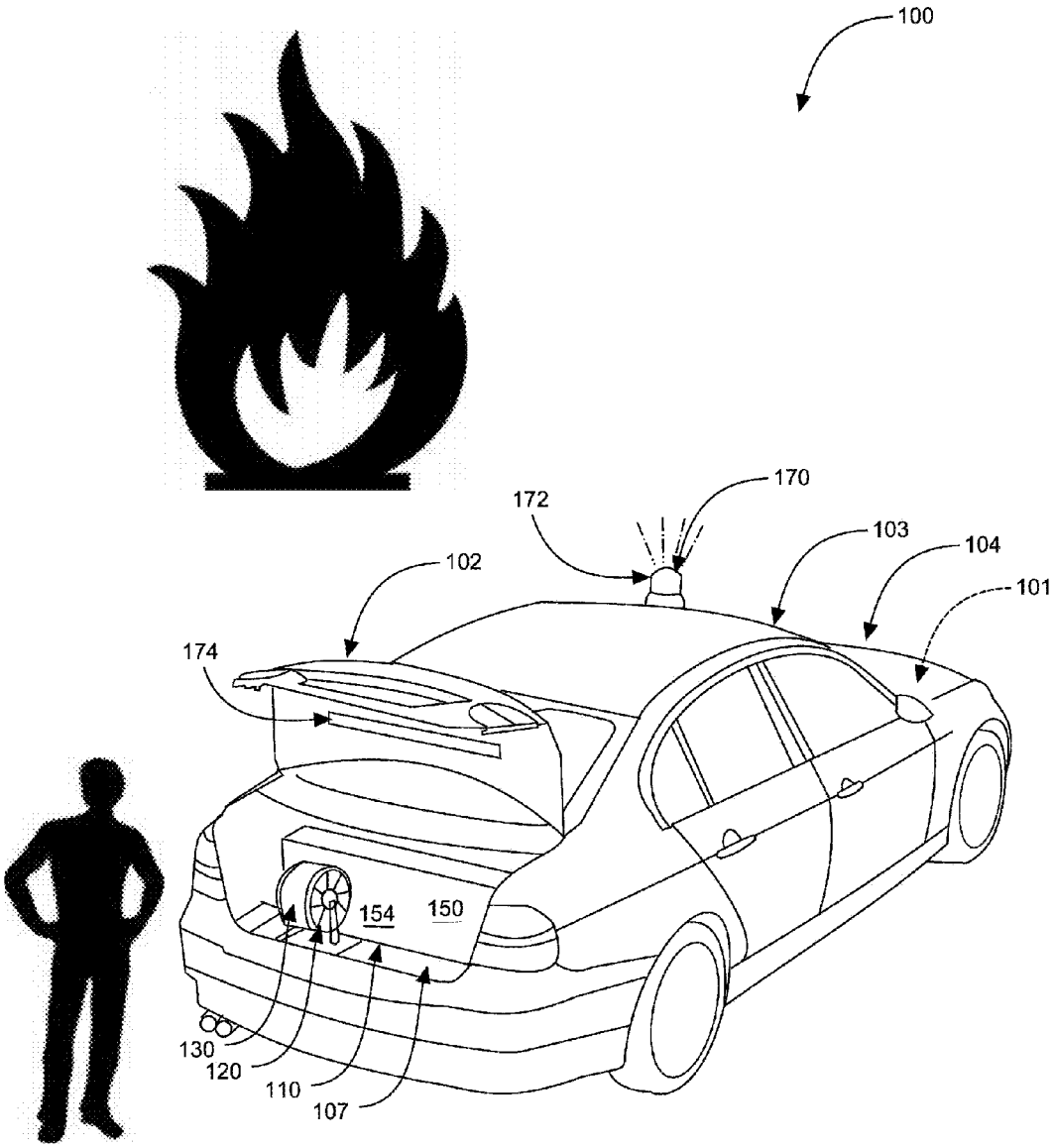
FIG. 1 shows a perspective view illustrating a self-contained fire-fighting system for use in a passenger vehicle upon arrival at a fire scene according to an embodiment of the present invention.

As discussed above, embodiments of the present invention relate to a fire-fighting device and more particularly to a self-contained firefighting apparatus as used to improve the efficiency and effectiveness of fighting fires upon first response.

Generally speaking, the specially designed self-contained fire-fighting apparatus entitled 'Hero's' is designed to be installed in a motor vehicle's trunk, powered by the vehicle's battery, and equipped with a rechargeable reservoir of high-pressure, fire-fighting foam.

The Hero's apparatus may be a modular, self-contained unit, sufficiently compact to permit permanent (or non-permanent) mounting in the trunk of a full-size passenger vehicle such as a family sedan, EMS van or SUV, or police cruiser. The Hero's system will feature a rechargeable battery pack which can be powered and recharged by the vehicle's battery, or through a standard AC outlet, and will depend upon several components: 1) a rechargeable, pressurized reservoir or tank of fire retardant foam, rechargeable/refillable by firms that service and maintain fire-extinguishers, this reservoir capable of maintaining the charged pressure indefinitely; 2) an electrically powered pressurization pump that maintains the reservoir at sufficient pressure, and also provides additional pressure to the reservoir as the foam is dispensed in operation; 3) a flexible, high-pressure dispenser hose, flat when empty, 7 to 15 feet in length and locked and stored on a manual, crank handled reel mounted to the floor of the trunk on the driver's side; and 4) a high pressure dispenser nozzle, specifically designed to handle, release, and accurately dispense the high-pressure foam, and equipped with an open/shut high-pressure release valve. Additional, the Hero's device may include a GPS device to alert the nearest fire department when the Hero's device is activated.

The Hero's system may be mounted permanently (or non-permanently) in any vehicle trunk, or any mode of transportation, or any place a human can be burned in the event of an accident, such as in trains (Amtrac, etc.), hotels, planes, cars, diesel trucks, and in heavy equipment. The Hero's system may be flushed-out prior to recharging, the foam-tank or reservoir being equipped with a high-pressure recharge fitting that may be used both for recharging with fire-retardant foam, and for flushing out with a cleaning solvent. A clear fill hose may have a one way valve for use when filling or refilling the unit. In this manner, the clear hose "window" may be observed as it is filled. It is desirable to equip the unit with a pressure/refill indicator gauge, wiring the gauge for installation in the vehicle's dashboard. Additionally, the clear hose also preferably includes a cap to prevent the Hero's device from leaking. The clear hose may include reflective tape running the entire length of the hose for ease of use in dark conditions. A simple On/Off switch located on the nozzle may be included for powering the unit on and off thereby preserving high-pressure fire retardant foam.

For safety-conscious motorists and for a wide variety of first responders, the Hero's will provide compact, immediately accessible, and effective firefighting capability. The safety-conscious motorist, realizing that time is of the essence in the moments following an accident, will appreciate the fact that the Hero's apparatus can be accessed and used immediately, no need to wait for the ambulance or fire-truck if fire is a threat. The present invention comprises high-pressure, heavy-duty capability. Likewise, for first responders such as police, highway patrol, and EMS units, the Hero's instant readiness, ample hose length, and high-pressure fire-retardant foam will prove far superior in capacity and performance to virtually any handheld fire-extinguisher. Further, the system may be used for Military use as well such as during combat such as on armed forces vehicles for example.

Designed to be compact and for ease of use, the present invention is also designed for long-term service, being easily rechargeable when necessary, and featuring a high pressure reservoir which keeps the retardant foam ready for use at a moment's notice. Off-duty firefighters and many others may find use with the present invention.

Referring to the drawings by numerals of reference there is shown in FIG. 1, a perspective view illustrating self-contained fire-fighting system 100 for use in a passenger vehicle 104 upon arrival at a fire scene according to an embodiment of the present invention.

Self-contained fire-fighting system 100 for use in a passenger vehicle 104 comprises: fire-fighting assembly 110 including reel 120, at least one deployable hose 130 with nozzle 132; the nozzle 132 for controlling flow of fire-fighting-liquid 180, pump 140, reservoir 150, powerer 160, and at least one emergency indicator 170. Fire-fighting assembly 110 is self-contained for placement in passenger vehicle 104; fire-fighting assembly 110 comprising in combination reel 120, the at least one deployable hose 130, pump 140, reservoir 150, and powerer 160; fire-fighting assembly 110 being portable. Deployable hose 130 is (sequentially) wrapped on reel 120 and the at least one deployable hose 130 is able to be wound onto and unwound from reel 120 as desired; reel 120 may be manually operated via a hand crank (not shown).

Reservoir 150 comprises inner volume 152 to hold at least one fire-fighting-liquid 180. Pump 140 comprises a high-pressure-pump for discharging at least one fire-fighting-liquid 180 from reservoir 150 through the at least one deployable hose 130 when pump 140 is activated. Powerer 160 is able to be manipulated between an on-condition and an off-condition via switch 190 to activate and de-activate pump 140, respectively. Powerer 160 provides power to operate pump 140 when switch 190 is in the on-condition.

Emergency indicator 170 indicates an in-use condition while operating self-contained fire-fighting system 100; emergency indicator 170 providing a visual warning (illumination) to on-coming motorists of an emergency situation. Fire-fighting assembly 110 is self-contained for placement (fixed or non-fixed) in passenger vehicle 104; fire-fighting assembly 110 is useful for first response in fire-fighting situations. Emergency indicator 170 comprises beacon 172 with LED (or other) lights and is powered when the in-use condition exists; the emergency indicator 170 operated by switch 190. Emergency indicator 170 may further comprise an LED-light-bar 174 located on an inside of a trunk-lid 102. In this way passenger vehicle 104 is made more visible even in lowlight or smoky conditions.

Deployable hose 130 of self-contained fire-fighting system 100 preferably comprises reflective strips as an indicator of where at least one deployable hose 130 is located during lowlight conditions to prevent injury to onlookers and damage to deployable hose 130. In this way the present invention promotes safety in use. Self-contained fire-fighting system 100 preferably further comprises GPS 108 as a position tracker that is able to signal to at least one other responder a position-and-emergency-condition-present.

Figure 2:
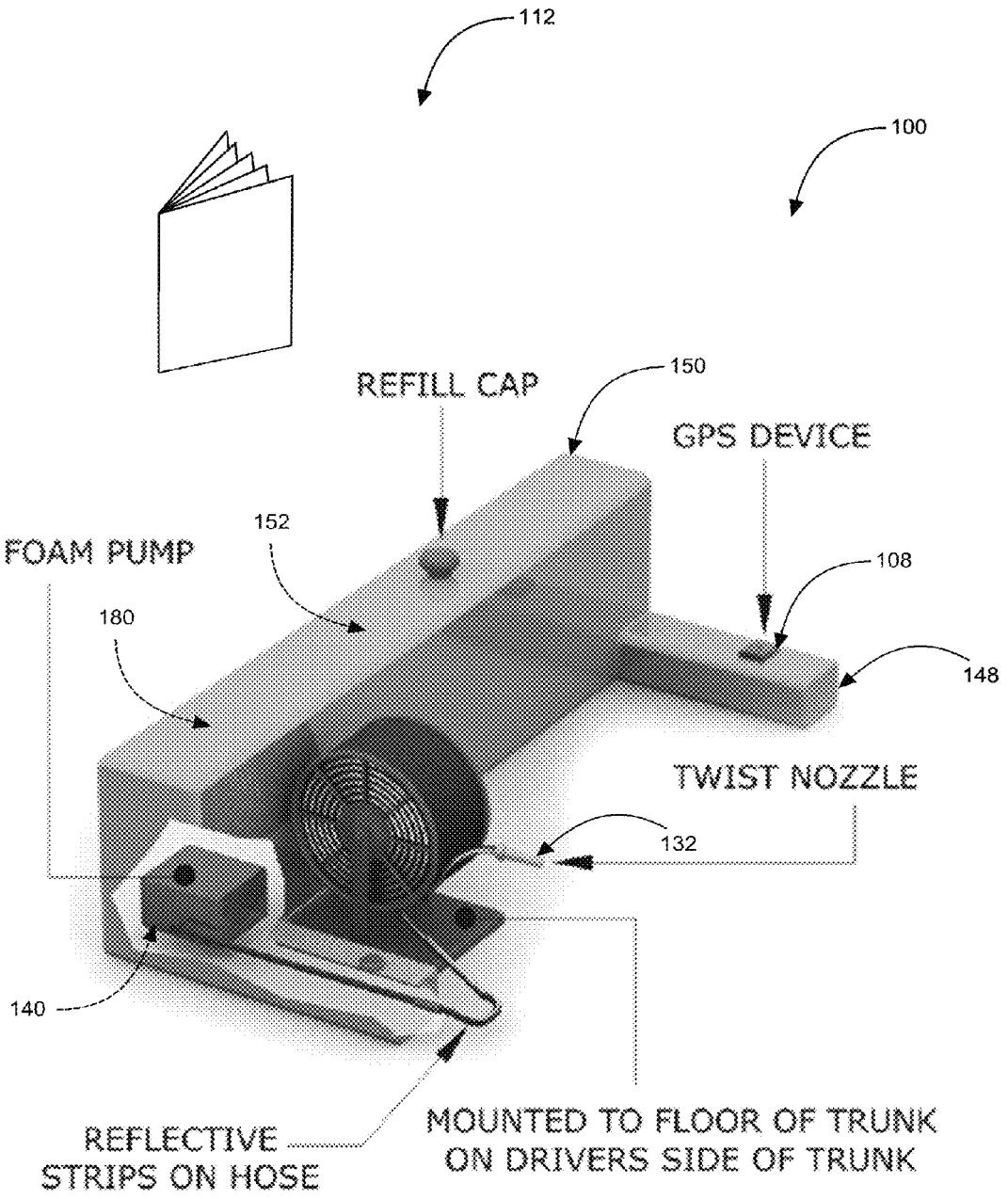
FIG. 2 is a perspective view illustrating a reservoir comprising a skid-frame of a fire-fighting assembly according to an embodiment of the present invention of FIG. 1.

Referring now to FIG. 2, a perspective view illustrating reservoir 150 comprising skid-frame 148 of fire-fighting assembly 110 according to an embodiment of the present invention of FIG. 1. Powerer 160 may be recharged via battery 101 onboard passenger vehicle 104. Powerer 160 may alternately be a battery pack that may be recharged via an AC outlet power source (not shown).

Figure 3:
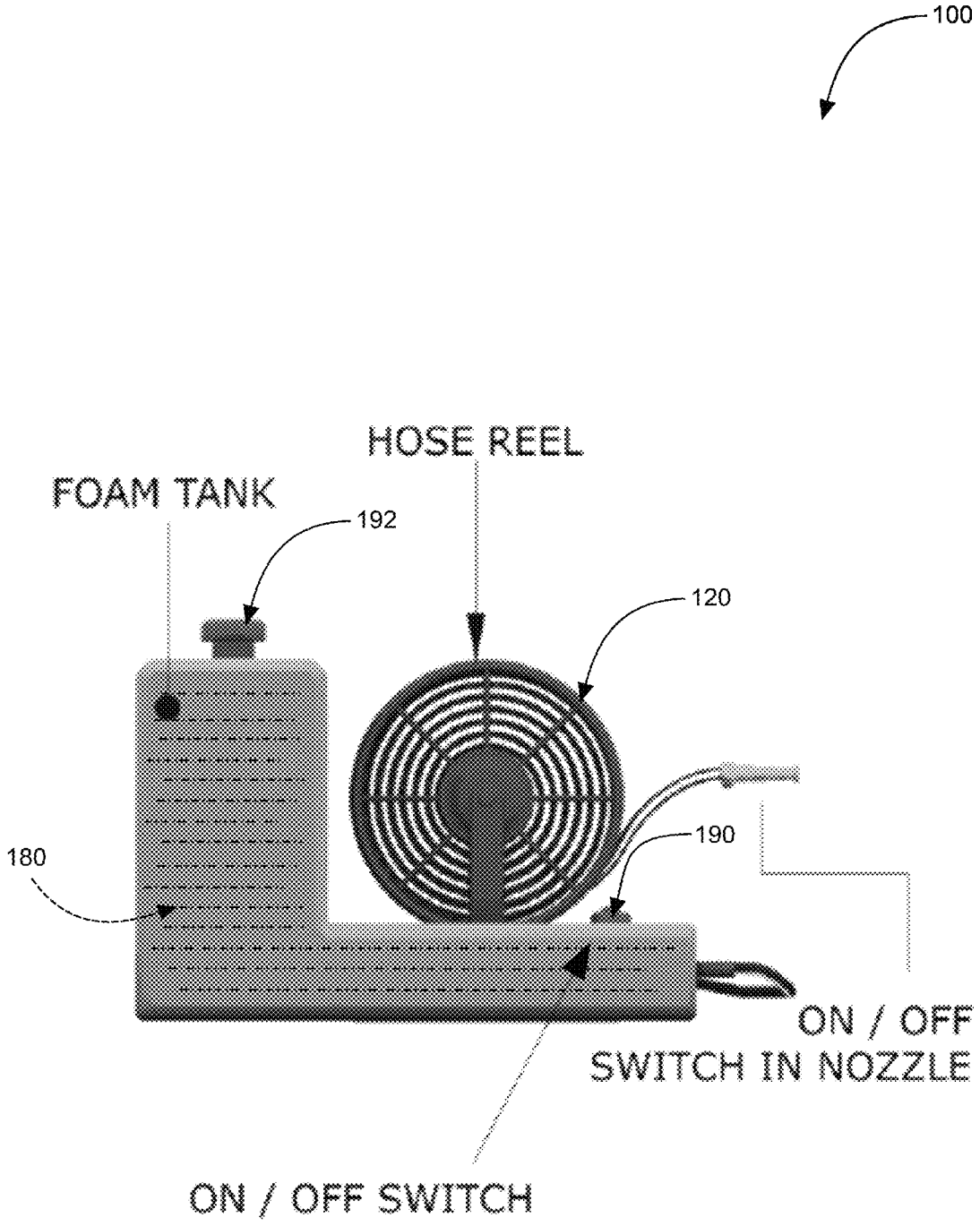
FIG. 3 is a side view illustrating the reservoir, reel, and switch according to an embodiment of the present invention of FIGS. 1-2.

Referring now to FIG. 3, a side view illustrating reservoir 150, reel 120, and switch 190 according to an embodiment of the present invention of FIGS. 1-2.

Reservoir 150 comprises skid-frame 148. Reservoir 150 holds fire-fighting-liquid 180 which may comprise water or foam, and/or fire-fighting-liquid 180 may comprise water and foam. Reservoir 150 is a pressurized container 154 that is able to be recharged with the foam; the pressurized container 154 able to maintain a constant pressure over an extended period. Self-contained fire-fighting system 100 for use in passenger vehicle 104 may further comprise a high-pressure recharge fitting 192 preferably located on reservoir 150. Pressure/refill indicator gauge 194 may be located in a dash of passenger vehicle 104; pressure/refill indicator gauge 104 indicating a relative charge of fire-fighting-liquid 180 within reservoir 150. Pressure/refill indicator gauge 194 may be located on reservoir 150 in alternate embodiments. Those with ordinary skill in the art will now appreciate that upon reading this specification and by their understanding the art of charging as described herein, methods of charging and indicating means will be understood by those knowledgeable in such art.

Figure 4A:
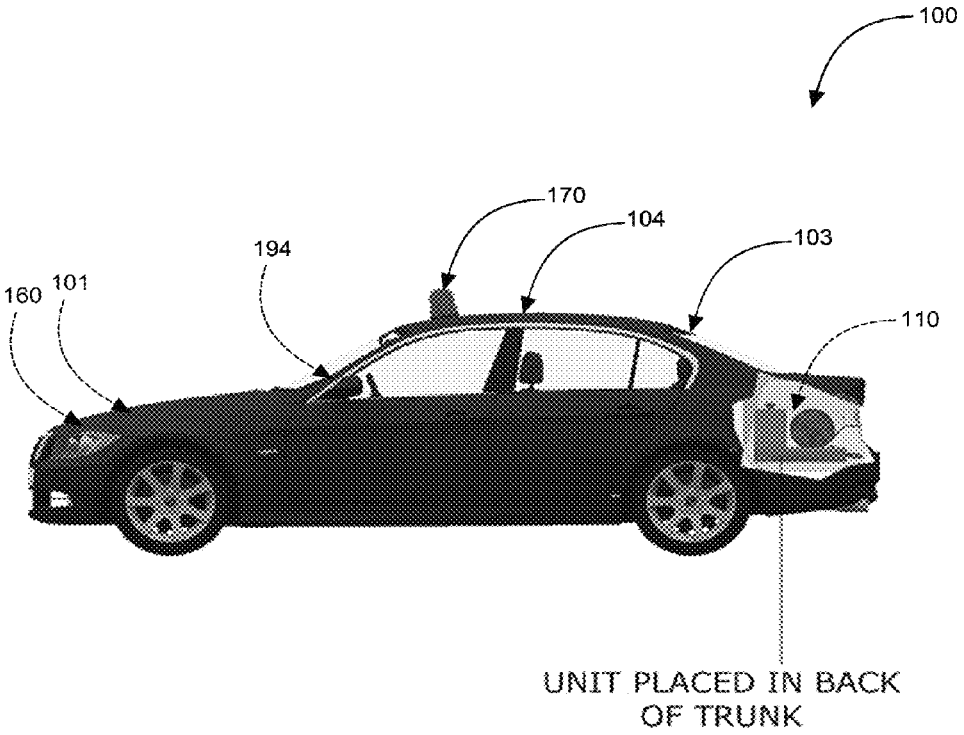
FIG. 4A is a perspective view illustrating a car with a self-contained fire-fighting system onboard according to an embodiment of the present invention of FIGS. 1-3.
Figure 4B:
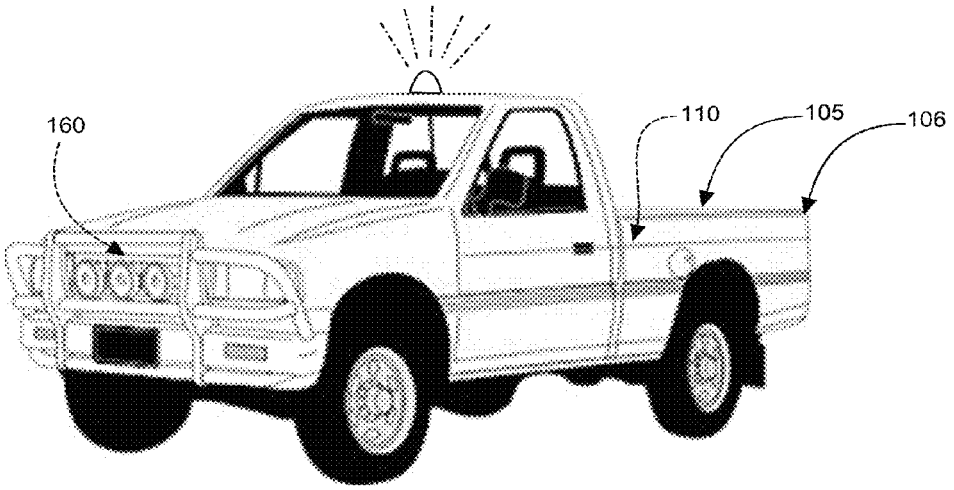
FIG. 4B is a perspective view illustrating a truck with a self-contained fire-fighting system onboard according to an embodiment of the present invention of FIG. 1.

Referring now to FIG. 4A, a perspective view illustrating car 103 with self-contained fire-fighting system 100 onboard according to an embodiment of the present invention of FIGS. 1-3. FIG. 4B is a perspective view illustrating pick-up truck 106 with self-contained fire-fighting system 100 onboard according to an embodiment of the present invention of FIG. 1.

Fire-fighting assembly 110 is able to be removably installed in trunk 107 of passenger vehicle 104; passenger vehicle 104 comprising car 103 in certain embodiments, as shown in FIGS. 1 and 4A. Fire-fighting assembly 110 is able to be removably installed in box 105 of passenger vehicle 104; passenger vehicle 104 comprising pick-up truck 106, as shown in FIG. 4B. Fire-fighting assembly 110 may be placed in various vehicles and shared between vehicles when desired.

Self-contained fire-fighting system 100 may be sold as kit 112 comprising the following parts: at least one fire-fighting assembly 110; at least one emergency indicator 170; decals; and at least one set of user instructions. Self-contained fire-fighting system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different powering combinations, parts may be sold separately, etc., may be sufficient.

Figure 5:
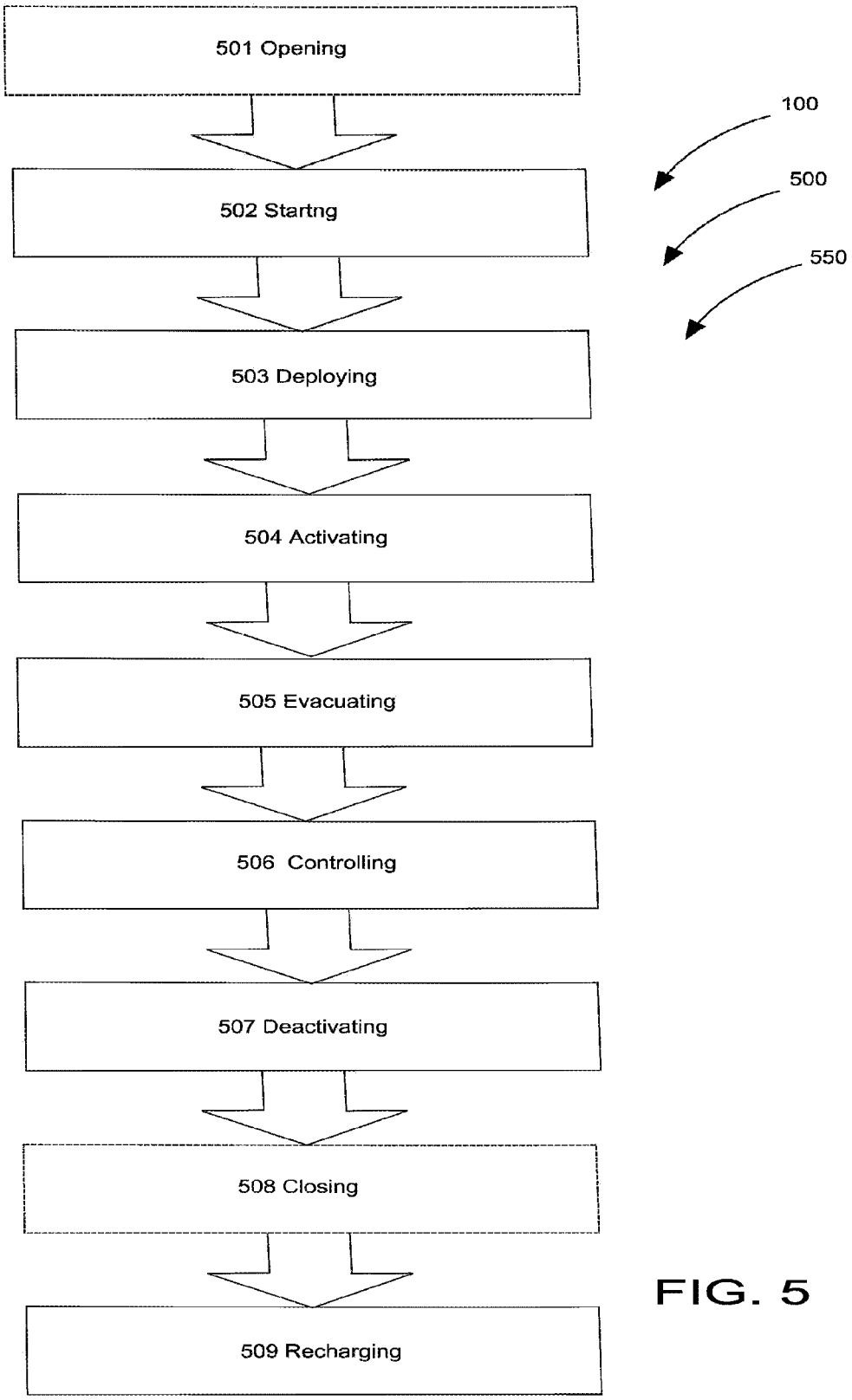
FIG. 5 is a flowchart illustrating a method of use for the self-contained fire-fighting system for use in a passenger vehicle according to an embodiment of the present invention of FIGS. 1-4B.

Referring now to FIG. 5, a flowchart 550 illustrating a method of use 500 for the self-contained fire-fighting system 100 for use in passenger vehicle 104 according to an embodiment of the present invention of FIGS. 1-4B.

A method of using (method of use 500) self-contained fire-fighting system 100 for use in passenger vehicle 104 comprises the steps of: step one 501 opening trunk-lid 102 (on car-versions), step two 502 starting emergency indicator 170 to provide a visual warning, step three 503 deploying deployable hose 130 from reel 120 via a crank, step four 504 activating powerer 160 (generator, or battery pack or battery powered) via switch 190 to power pump 140, step five 505 evacuating foam (fire-fighting-liquid 180) under pressure contained within reservoir 150 from deployable hose 130 using pump 140 onto a fire, step six 506 controlling the fire until emergency personnel and equipment arrive, step seven 507 de-activating powerer 160, rolling up deployable hose 130 onto reel 120 via the crank, step eight 508 closing trunk-lid 102 (on car-versions), and step nine 509 recharging fire-fighting-liquid 180 in reservoir 150 before a next usage.

It should be noted that steps 501 and 508 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A self-contained fire-fighting system for use in a vehicle comprising:

a) a fire-fighting assembly including;
  i) a reel;
  ii) at least one deployable hose comprising reflective strips;
  iii) a high-pressure dispenser nozzle with an open/shut high-pressure release valve;
  iv) a pump comprising an electrical input;
  v) a rechargeable pressure reservoir comprising a skid-frame;
  vi) a high-pressure recharge fitting;
  vii) a pressure/refill indicator gauge;
  viii) a foam fire-fighting-liquid;
  ix) a cleaning solvent;
  x) a powerer;
  xi) a clear fill-hose comprising a one-way valve and a sealing cap;
  xii) a passenger vehicle comprising a dash and a trunk;
  xiii) an emergency indicator comprising two or more LED lights; and
  xiv) a passenger vehicle trunk-lid comprising an LED light bar;

b) wherein said fire-fighting assembly is self-contained for placement in said passenger vehicle;

c) wherein said LED light bar is structured and arranged on an inside portion of said passenger vehicle trunk-lid and further structured and arranged such that light emanating from said LED light bar illuminates a space outside of said passenger vehicle possessing said passenger vehicle trunk-lid and further wherein said LED light bar illuminates a least a portion of said fire-fighting assembly when said passenger vehicle trunk-lid is placed in an open position;

d) wherein said at least one deployable hose is removably structured and arranged on said reel and is structured and arranged to removably wind onto and unwind from said reel when pressurized with said foam fire-fighting-liquid by said pump;

e) wherein said high pressure dispenser nozzle is structured and arranged with said at least one deployable hose and further structured and arranged with said open/shut high-pressure release valve for controlled-releasing and pointedly-dispensing said foam fire-fighting liquid;

f) wherein said high-pressure recharge fitting is structured and arranged on a surface of said rechargeable pressure reservoir and further structured and arranged with said cleaning solvent for flushing-out said rechargeable pressure reservoir prior to recharging said rechargeable pressure reservoir with said foam;

g) wherein said rechargeable pressure reservoir comprises an inner volume that is structured and arranged to hold sufficient said foam fire-fighting-liquid for maintaining at least one constant pressure over a time-period of one vehicle fire of said passenger vehicle;

h) wherein said pump comprises a high-pressure-pump structured and arranged with said powerer, said rechargeable pressure reservoir and a switch for discharging said foam fire-fighting-liquid from said rechargeable pressure reservoir through said at least one deployable hose when said pump is activated;

i) wherein said powerer is structured and arranged with said switch whereby said powerer is manipulatable between an on-condition and an off-condition via said switch;

j) wherein said powerer provides electrical power directly to said pump when said switch is in said on-condition;

k) wherein said emergency indicator is structured and arranged with a beacon which is structured and arranged with said two or more LED lights and electrically connected to said powerer by said switch, thereby indicating an in-use condition while operating said self-contained fire-fighting system, said emergency indicator providing a visual warning that is visible to on-coming motorists of an emergency situation;

l) wherein said clear fill-hose one-way valve is structured and arranged with said high-pressure recharge fitting, and further structured and arranged with said pressure/refill indicator gauge for refilling said rechargeable pressure reservoir, and further structured and arranged such that said sealing cap prevents leaking of said foam fire-fighting-liquid from said high-pressure recharge fitting; and m) wherein said pressure/refill indicator gauge is structured an arranged on said dash of said passenger vehicle and further structured and arranged with said rechargeable pressure reservoir for indicating a relative charge of said foam fire-fighting-liquid within said rechargeable pressure reservoir;

n) whereby said fire-fighting assembly is useful for first response in firefighting situations comprising at least said one vehicle fire of said passenger vehicle.

2. The self-contained fire-fighting system for use in a vehicle of claim 1 wherein said at least one deployable hose reflective strips provide an indicator of where said at least one deployable hose is during lowlight conditions to prevent injury to onlookers and damage to said at least one deployable hose.

3. The self-contained fire-fighting system for use in a vehicle of claim 1 further comprising a GPS as a position tracker structured and arranged with the nearest fire department by signaling at least one other responder a position-and-emergency-condition-present.

4. The self-contained fire-fighting system for use in a vehicle of claim 1 wherein said powerer is recharged via a battery onboard said passenger vehicle.

5. The self-contained fire-fighting system for use in a vehicle of claim 1 wherein said powerer is recharged via an AC outlet power source.

6. The self-contained fire-fighting system for use in a vehicle of claim 1 wherein said foam fire-fighting-liquid comprises a mixture of foam and water.

7. The self-contained fire-fighting system for use in a vehicle of claim 1 wherein said skid-frame is structured and arranged permanently in said trunk.

8. The self-contained fire-fighting system for use in a vehicle of claim 1 wherein said fire-fighting assembly is removably installed in a trunk of said passenger vehicle, said passenger vehicle comprising a car.

9. The self-contained fire-fighting system for use in a vehicle of claim 1 wherein said fire-fighting assembly is removably installed in a box of said passenger vehicle, said passenger vehicle comprising a pick-up truck.

10. The self-contained fire-fighting system for use in a vehicle of claim 1 wherein said reel is manually operated via a hand crank.

11. A self-contained fire-fighting system for use in a vehicle comprising:

a) a fire-fighting assembly including;
   i) a reel;
   ii) a deployable hose with a nozzle, said nozzle for controlling flow from said deployable hose;
   iii) a pump;
   iv) a rechargeable pressure reservoir;
   v) a high-pressure recharge fitting located on said rechargeable pressure reservoir;
   vi) a pressure/refill indicator gauge; and
   vii) a powerer;

b) an emergency indicator; and c) a GPS;

d) wherein said fire-fighting assembly is self-contained for placement in a passenger vehicle;

e) wherein said deployable hose is wrapped on said reel and said deployable hose is able to be wound onto and unwound from said reel as desired;

f) wherein said reel is manually operated via a hand crank;

g) wherein said deployable hose comprises reflective strips as an indicator of where said deployable hose is located during lowlight conditions to prevent injury to onlookers and damage to said deployable hose;

h) wherein said rechargeable pressure reservoir comprises an inner volume to hold at least one firefighting-liquid, said rechargeable pressure reservoir having stabilizing arms;

i) wherein said pump comprises a high-pressure-pump for discharging said at least one fire-fighting-liquid from said rechargeable pressure reservoir through said deployable hose when said pump is activated;

j) wherein said rechargeable pressure reservoir comprises a skid-frame;

k) wherein said rechargeable pressure reservoir is a pressurized container that is able to be recharged with foam, said pressurized container able to maintain a constant pressure over an extended period;

l) wherein said fire-fighting assembly is able to be removably installed in a trunk of said passenger vehicle, said passenger vehicle comprising a car, said skid-frame sitting stably on a floor of said trunk, stability enhanced by said stabilizing arms;

m) wherein said at least one fire-fighting-liquid comprises said foam;

n) wherein said powerer is recharged via a battery onboard said passenger vehicle;

o) wherein said powerer is able to be manipulated between an on-condition and an off-condition via a switch;

p) wherein said powerer provides power to operate said pump when said switch is in said on-condition;

q) wherein said pressure/refill indicator gauge is located in a dash of said passenger vehicle, said pressure/refill indicator gauge indicating a relative charge of said rechargeable pressure reservoir;

r) wherein said emergency indicator indicates an in-use condition while operating said self-contained fire-fighting system, said emergency indicator providing a visual warning to on-coming motorists of an emergency situation;

s) wherein said emergency indicator comprises a beacon with LED lights and is powered when said in-use condition exists, said emergency indicator operated by said switch;

t) wherein said emergency indicator further comprises an LED light bar located on an inside of a trunk-lid;

u) wherein said GPS comprises a position tracker that is able to signal to at least one other responder a position-and-emergency-condition-present; and v) wherein said fire-fighting assembly useful for first response in firefighting situations.

12. The self-contained fire-fighting system for use in a vehicle of claim 11 further comprising a kit including: said fire-fighting assembly, said emergency indicator, decals and a set of user instructions.

13. A method of using said self-contained fire-fighting system of claim 11 comprising the steps of:

a) opening said trunk lid;

b) starting said emergency indicator to provide said visual warning;

c) deploying said deployable hose from said reel via said hand crank;

d) activating said powerer via said switch to power said pump;

e) evacuating foam under pressure contained within said rechargeable pressure reservoir from said deployable hose using said pump onto a fire;

f) controlling said fire until emergency personnel and equipment arrive;

g) de-activating said powerer;

h) rolling up said deployable hose onto said reel via said hand crank;

i) closing said trunk lid; and j) recharging said rechargeable pressure reservoir before a next usage.

* * * * *